US010038237B2

(12) United States Patent
Eastburg et al.

(10) Patent No.: US 10,038,237 B2
(45) Date of Patent: Jul. 31, 2018

(54) MODIFIED CAVITY-BACKED MICROSTRIP PATCH ANTENNA

(71) Applicant: Raytheon Company, Waltham, MA (US)

(72) Inventors: Jerret Eastburg, Albuquerque, NM (US); Michael T. Pace, Albuquerque, NM (US)

(73) Assignee: Raytheon Company, Waltham ( * ) Notice: Subject to any disclaimer, the term of this patent is extended or adjusted under 35 U.S.C. 154(b) by 243 days.

(21) Appl. No.: 14/938,256

(22) Filed: Nov. 11, 2015

(65) Prior Publication Data

US 2017/0133756 A1 May 11, 2017

(51) Int. Cl.

| | |
|---|---|
| ***H01Q 1/52*** | (2006.01) |
| ***H01Q 21/06*** | (2006.01) |
| ***H01Q 9/04*** | (2006.01) |
| ***H01Q 21/24*** | (2006.01) |
| ***H01Q 25/00*** | (2006.01) |

(52) U.S. Cl.

CPC ..... *H01Q 1/523* (2013.01); *H01Q 1/521* (2013.01); *H01Q 9/0407* (2013.01); *H01Q 9/0457* (2013.01); *H01Q 21/061* (2013.01); *H01Q 21/065* (2013.01); *H01Q 21/24* (2013.01); *H01Q 25/001* (2013.01)

(58) Field of Classification Search

CPC ..... H01C 1/523
USPC ..... 343/824
See application file for complete search history.

(56) References Cited

U.S. PATENT DOCUMENTS

| | | | | |
|---|---|---|---|---|
| 6,008,763 | A * | 12/1999 | Nystrom | H01Q 21/08 343/700 MS |
| 8,514,139 | B2 * | 8/2013 | Adams | H01Q 13/18 343/767 |
| 2011/0181482 | A1 | 7/2011 | Adams et al. | |
| 2013/0044035 | A1 * | 2/2013 | Zhuang | H01Q 9/0428 343/770 |

OTHER PUBLICATIONS

PCT Search Report and Written Opinion of the ISA dated Oct. 7, 2016; for PCT Pat. App. No. PCT/US2016/037744; 12 pages.

* cited by examiner

*Primary Examiner* — Dameon E Levi
*Assistant Examiner* — Walter Davis
(74) *Attorney, Agent, or Firm* — Daly, Crowley, Mofford & Durkee, LLP

(57) ABSTRACT

Described embodiments provide an antenna for transmitting and receiving radio frequency (RF) signals. The antenna includes an antenna element and an antenna feed network coupled to the antenna element. The antenna feed network is disposed on a first side of the antenna element. A cavity structure is disposed around the antenna feed network. The cavity structure includes conductive walls defining an antenna element cavity. The walls have a height defining a depth of the cavity. An intracavity wall is disposed within the cavity between feed lines of the antenna feed network. The intra-cavity wall is provided having dimensions selected to reduce cross-coupling within the cavity.

23 Claims, 5 Drawing Sheets

MODIFIED CAVITY-BACKED MICROSTRIP PATCH ANTENNA

BACKGROUND

It is often desirable to integrate RF antenna arrays into the outer surfaces (or "skins") of aircraft, cars, boats or other vehicles, as well as in walls of commercial or residential structures (e.g., for use in wireless LAN applications). Ideally, such antennas are flush-mounted within the skins or walls. To accomplish this, it is desirable to use antennas or radiators having a low profile and a wide bandwidth frequency response.

Cavity-backed slot antennas or cavity-backed microstrip patch antennas are commonly used for airborne and satellite-based applications, because they can be flush mounted and are low cost and light weight. The cavity height is usually designed to be one-quarter wavelength or three-quarters of a wavelength of the resonator frequency to maintain impedance matching. The cavity height and, thus, volume can be reduced through dielectric loading, but the bandwidth and efficiency will also be reduced.

Surface waves produced in conventional cavity-backed patch radiators have undesirable effects. For example, scan blindness (e.g., loss of signal) can occur at angles in phased arrays where surface waves modify the array impedance such that little or no power is radiated at a particular scan angle. The array field-of-view is thus often limited by the angle at which scan blindness occurs due to surface waves. Further, currents are induced on a patch radiator due to the radiated space waves and surface waves from nearby patch radiators.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments provide an antenna for transmitting and receiving radio frequency (RF) signals. The antenna includes an antenna element and an antenna feed network coupled to the antenna element. The antenna feed network is disposed on a first side of the antenna element. A cavity structure is disposed around the antenna feed network. The cavity structure includes conductive walls defining an antenna element cavity. The walls have a height defining a depth of the cavity. An intra-cavity wall is disposed within the cavity between feed lines of the antenna feed network. The intra-cavity wall is provided having dimensions selected to reduce cross-coupling within the cavity.

BRIEF DESCRIPTION OF THE DRAWING FIGURES

Aspects, features, and advantages of the concepts, systems, circuits and techniques described herein will become more fully apparent from the following detailed description, the appended claims, and the accompanying drawings in which like reference numerals identify similar or identical elements. Reference numerals that are introduced in the specification in association with a drawing figure may be repeated in one or more subsequent figures without additional description in the specification in order to provide context for other features. Furthermore, the drawings are not necessarily to scale, emphasis instead being placed on the concepts disclosed herein.

DETAILED DESCRIPTION

Phased array antennas (or more simply, "phased arrays") require a plurality of closely spaced antenna elements (or more simply "elements") for operation at wide scan angles. However, closely spaced antenna elements might experience cross-coupling between adjacent or proximately disposed elements, which negatively effects the gain and maximum scan angle of the array. Reducing (and ideally minimizing), cross-coupling between antenna elements and increasing (and ideally maximizing) cross-polarization isolation within each antenna element results in the array having an increased (and ideally maximized) gain characteristic. For phased arrays disposed on vehicles (e.g., aircraft), a height of the array (e.g., a height of each antenna element) is a limiting factor of the array size and design, and the array is ideally in-plane with an exterior surface of the vehicle (e.g., flush mounted) to reduce drag of the vehicle (e.g., an aircraft, etc.). Thus, described embodiments provide a low-profile planar array having reduced cross-coupling between adjacent and proximate antenna elements and increased cross-polarization isolation within each element as compared with prior art arrays having generally the same size, shape and operating frequency.

Embodiments described herein reduce cross-coupling between adjacent and proximate antenna elements by adding conductive cavity walls. The cavity walls reduce electric fields coupled between the internal ground layers of the feed structures and the reflector plate (e.g., ground plane) and, thus, increase isolation between adjacent and proximate antenna elements. The cavity walls, however, tend to decrease the isolation between orthogonal polarizations within a cavity, which thereby decreases the cross-polarization discrimination of the aperture of each antenna. Therefore, described embodiments add an additional conductive wall (e.g., an "intra-cavity" wall) within the cavity and aperture of each antenna element to isolate the two polarizations.

Described embodiments are directed toward an array provided from a plurality of conductive cavities with each conductive cavity disposed about a dual polarization feed and antenna element. The cavity reduces back radiation from the antenna elements (e.g., patch antenna elements). The conductive cavities also utilize an intra-cavity wall. The intra-cavity wall increases isolation between orthogonal polarizations of the same antenna element. Thus, described embodiments have improved cross-coupling between antennas and cross-polarization isolation for each antenna, which, in turn, increases the gain of the array. The "intra-cavity" makes an array provided from such antenna elements more robust than traditional aperture-coupled microstrip patch arrays, making the described antennas suitable for operation on mobile platforms much as vehicles or aircraft in a digitally beam-formed phased array.

Figure 1:
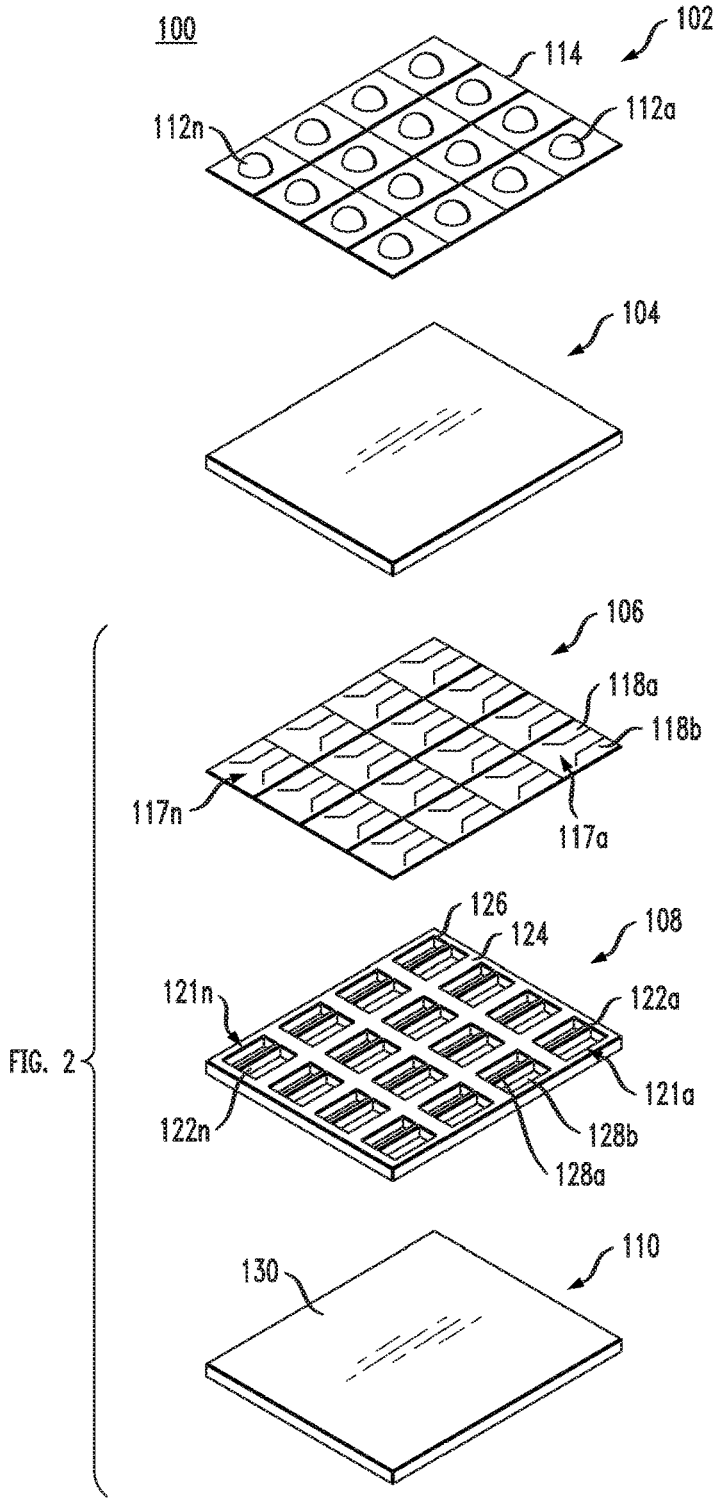
FIG. 1 is an exploded isometric view of an illustrative array of cavity-backed antennas in accordance with described embodiments.

Referring to FIG. 1, cavity-backed patch antenna array 100 is shown to include patch antenna layer 102 disposed over a dielectric (or foam) layer 104, a feed network layer 106, a cavity structure layer 108 and a ground plane layer 110.

Patch antenna layer 102 includes a plurality of patch antenna elements 112*a*-112*n* (generally referred to as patches 112) which are arranged on a substrate, such as a printed circuit board, 114. In some embodiments, patch 112 is circular, such as shown in FIG. 1, although it will be appreciated by those of ordinary skill in the art that patches 112 could be rectangular, circular or have any regular or irregular shape or features to control radiation and mode excitation. The size (e.g., radius, etc.) of patch 112 is a function of the frequency or frequencies of operation of array 100. Those of skill in the art will understand how to select the size and shape of a patch element to meet the needs of a particular application. An arbitrary number of patches 112 might be sized and shaped to have given antenna properties and grouped to form patch antenna layer 102 of array 100. Using techniques known in the art, patches 112 can be fabricated to suit the needs of a particular application, polarization requirement (e.g., linear or circular) and mounting surface.

Patch antenna layer 102 is preferably fabricated from a conventional dielectric material (e.g., Rogers R/T Duroid®) having 0.5 oz. copper layers that are fusion bonded on to each side of the dielectric. Patch antenna layer 102 might also serve as a radome for cavity-backed patch antenna array 100, for example to be planar with an exterior surface of a carrier of cavity-backed patch antenna array 100 (e.g., a vehicle or aircraft, etc.). Other embodiments might employ a separate radome to cover patch antenna layer 102.

Foam or dielectric layer 104 is disposed between patch antenna layer 102 and feed network layer 106. Dielectric layer 104 operates to dielectrically load patch 112, for example to increase the effective aperture size of array 100 without increasing the physical size of individual antenna elements (e.g., patches 112). In some embodiments, dielectric layer 104 might be provided as a cross-linked polystyrene copolymer (e.g., polystyrene divinylbenzene) such as Rexolite®. It will be appreciated that any suitable material used for high frequency substrates, microwave components, and lenses with acoustic, optical and radio frequency applications and having desirable electrical properties at high frequencies might be used. For example, any suitable material having similar dielectric and mechanical properties to Rexolite® might be used in particular applications based upon the needs of the particular application. For example, in embodiments for X-band frequencies, dielectric layer 104 might typically have a thickness of 0.01λ to 0.05λ, where λ is the wavelength of the frequency of operation of antenna array 100.

Feed network layer 106 is disposed above cavity structure layer 108. This arrangement combines the bandwidth benefits of a stacked patch antenna with the isolation characteristics of a waveguide radiator in a single laminated structure without the need of physical RF interconnects with feed network layer 106 passing electromagnetic signals to antenna layer 102. Feed network layer 106 might be provided from a conventional dielectric laminate (e.g., Rogers R/T Duroid®) and might be fabricated using standard manufacturing techniques such as drilling, copper plating, etching and lamination.

Feed network layer 106 includes feed elements 117*a*-117*n* each coupled to a corresponding one of patches 112*a*-112*n*, and referred to generally as feed element 117. Each feed element 117 includes feed lines 118*a* and 118*b* (referred to generally as feed lines 118) that feed (or more generally, are coupled to) antenna elements 112. In some embodiments, feed lines 118 electromagnetically couple signals between respective ones of patches 112 and a radio frequency circuit (not shown). Each feed thus couples electromagnetic signals to and from patch antenna layer 102.

Cavity structure layer 108 includes conductive walls 126 (also referred to as cavity element walls 126) that define a plurality of waveguide cavities 121*a*-121*n* (generally referred to as cavities 121). Each of cavities 121 are disposed beneath a corresponding one of patches 112 and feed elements 117. As shown in FIG. 1, when multiple antennas are disposed to form an array, walls 126 form a lattice of cavity walls, shown as cavity lattice 124. The dimensions of cavity 121 are determined by the size and spacing of patches 112. In one embodiment, cavity 121 has an opening having sides having a length between 0.5λ and 0.05λ, where λ is the wavelength of the frequency of operation of antenna array 100.

Cavity structure layer 108 includes intra-cavity wall 122*a*-122*n* in each cavity 121*a*-121*n*. As will be described in greater detail in regard to FIG. 3, adding the intra-cavity wall increases isolation between orthogonal polarizations of the same antenna element. Thus, the inclusion of intra-cavity walls 122 in each cavity 121 improves cross-coupling between antennas and cross-polarization isolation for each antenna, which increases the gain of the array. The "intra-cavity" wall thus makes the antenna more robust than traditional aperture-coupled microstrip patch arrays, making the described antennas suitable for operation on mobile platforms such as vehicles or aircraft in a digitally beam-formed phased array.

Cavity structure layer 108 is preferably machined or otherwise provided from a conductive material (e.g., aluminum stock) that is relatively strong and lightweight. It should be appreciated that cavity structure layer 108 might also be fabricated by injection molding the lattice structure and metalizing the structure with copper or other conductive materials.

As the thickness of a conventional antenna with dielectric or foam substrates increases to enhance bandwidth, the angle at which the lowest order surface wave can propagate decreases thereby reducing efficient antenna performance over a typical phased array scan volume. However, the waveguide architecture of cavity 121 reduces surface waves that are coupled between various of patches 112, enabling increased bandwidth and scan volume performance (greater than ±70°) which are critical parameters for multi-function phased arrays.

Ground plane layer 110 is disposed below cavity structure layer 108, forming a bottom of cavity 121. Ground plane layer 110 might be provided from an electrically conductive material or from a dielectric substrate having a conductive material 130 disposed thereon. Each cavity 121 formed by walls 126 and ground plane 110 physically and electrically isolates each antenna element 112 from all other antenna elements. Walls 126 and ground plane 110 present an electrically reflecting boundary condition. In either transmit or receive mode operation, the electromagnetic fields inside a given cavity 121 are isolated from all other cavities 121 in cavity-backed patch antenna array 100. Thus, internally excited surface waves are substantially reduced independent of cavity height, lattice geometry, scan-volume, polarization or bandwidth requirements.

Thus, cavity-backed patch antenna array 100, formed by patch antenna layer 102, dielectric layer 104, feed network layer 106, cavity structure layer 108 and ground plane layer 110 form a thin, light, mechanically simple, and low cost antenna. Adjustment of the height of walls 126 primarily influences the coupling between patches 112 and feed elements 118, thereby controlling a resonant frequency and bandwidth of each patch 112 and, thus, of cavity-backed patch antenna array 100.

Figure 2:
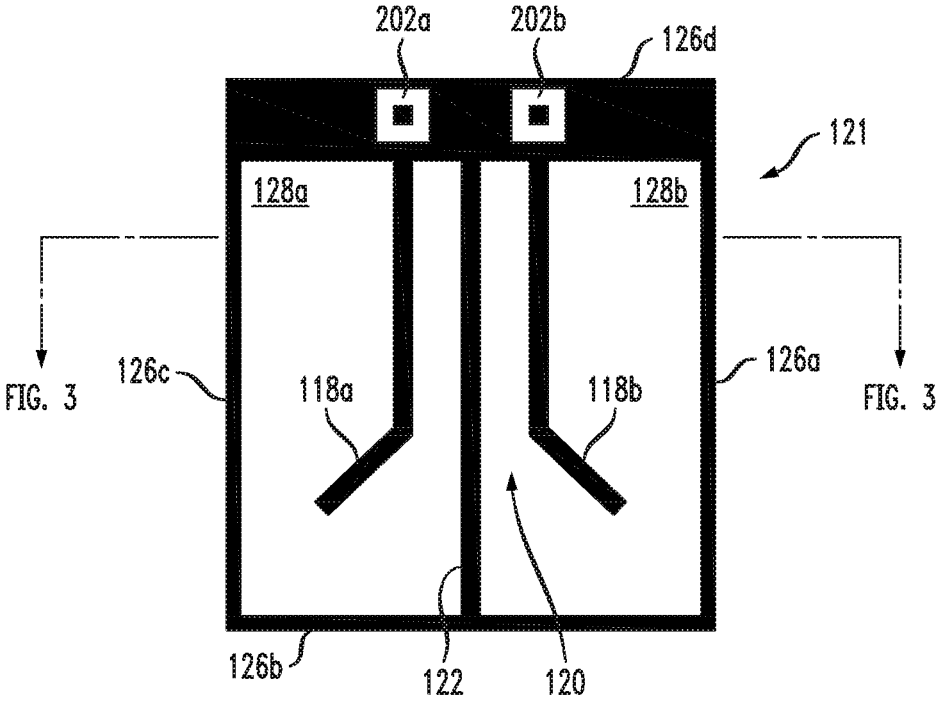
FIG. 2 is top view of an illustrative cavity-backed antenna of the array of FIG. 1 in accordance with described embodiments.

Referring now to FIG. 2, further details of the cavity formed by feed network layer 106, cavity structure layer 108 and ground plane layer 110 are shown with like reference numbers referring to like elements in FIG. 1. FIG. 2 shows atop-down view of single cavity 121. As shown, cavity 121 is formed by walls 126*a*, 126*b*, 126*c* and 126*d*. Feed lines 118*a* and 118*b* are coupled to orthogonal RF signals by RF couplings 202*a* and 202*b*, respectively. Thus, each patch 112 is a dual polarized antenna element.

Feed tines 118*a* and 118*b* might be implemented as conductive feed lines (such as shown in FIG. 2) or might be implemented as slots in a conductive surface (e.g., as feed apertures). In embodiments such as shown in FIG. 2, feed lines 118*a* and 118*b* might implement aperture coupled slots that are incorporated on a ground plane between substrate layers on the feed network layer 106. There is a space between feed lines 118*a* and 118*b*, shown as space 120. Intra-cavity wall 122 is disposed within space 120 between feed lines 118*a* and 118*b*. Intra-cavity wall 122 thus partitions cavity 121 into sub-cavities 128*a* and 128*b*.

Figure 3:
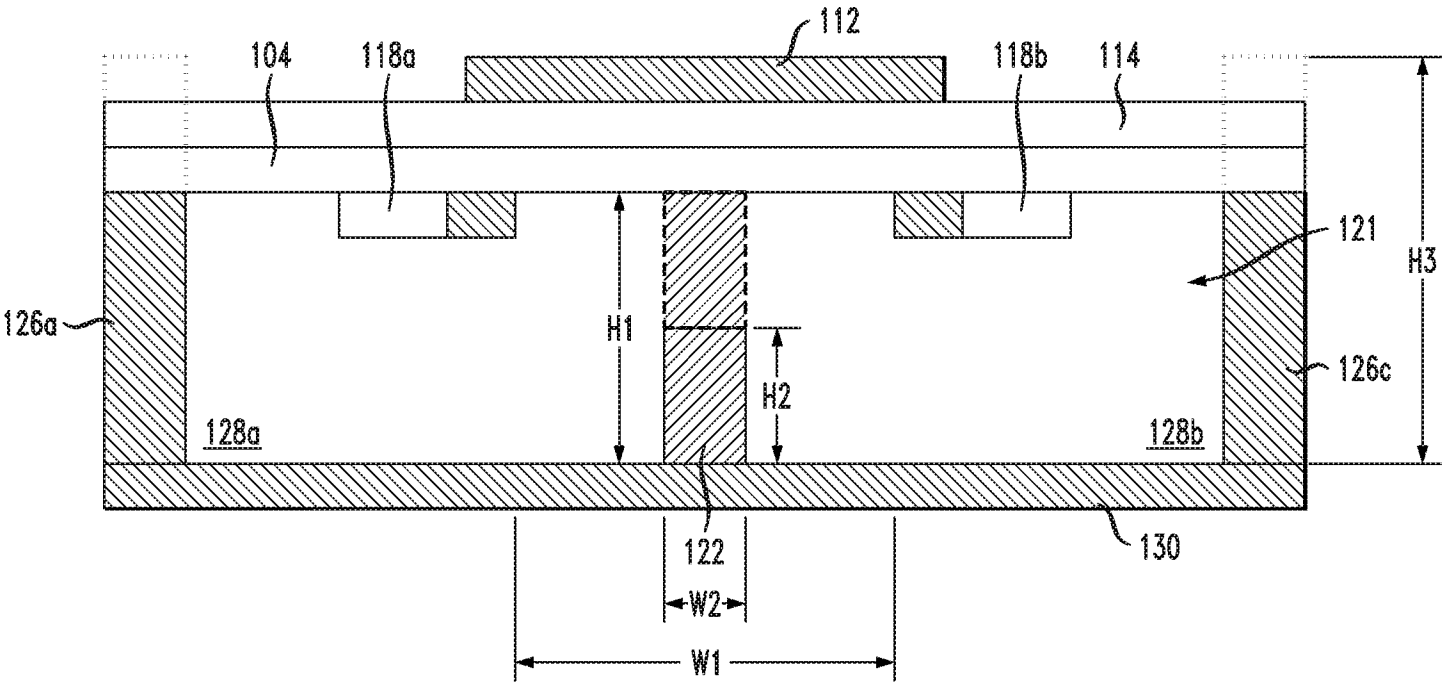
FIG. 3 is a cross-sectional view taken across line 3-3 of the cavity-backed antenna of FIG. 2.

Referring now to FIG. 3, further details of the cavity-backed patch antenna array 100 are shown with like reference numbers referring to like elements in FIGS. 1 and 2. FIG. 3 shows a cross-sectional view of a single antenna element and cavity of array 100, the cross-section taken along line 3-3 indicated in FIG. 2. As shown in FIG. 3, patch antenna layer 102 includes a conductor (e.g., patch 112) disposed on a first or upper surface of substrate 114. Dielectric layer 104 (e.g., a foam layer) is disposed over a second or lower surface of substrate 114 and is coupled to a first portion (here an upper surface) of walls 126 (shown as walls 126*a* and 126*c* in FIG. 3). Feed lines 118*a* and 118*b* are disposed on the second or lower surface of dielectric layer 104.

In some embodiments, walls 126 have a height such that the tops of walls 126 are the same height as the top of patch antenna layer 102, as indicated by the dashed lines and height H3. Such extension of walls 126 effectively increases the cavity height by the height of patch antenna layer 102 dielectric layer 104. In some such embodiments, the extended cavity walls (e.g., represented by the dashed lines in FIG. 3) are part of a cavity extension layer (not shown) that replaces dielectric layer 104. The cavity extension layer is electrically connected, using vias, through the circuit board of feed network layer 106 to cavity walls 126.

Ground plane 110 is coupled to a portion (here the bottom) surface of walls 126, thereby forming a bottom surface of cavity 121 between dielectric layer 104, ground plane 110, and walls 126. As shown, walls 126 and, thus, cavity 121, have a height of H1. Feed lines 118*a* and 118*b* are disposed within cavity 121.

Intra-cavity wall 122 is disposed within cavity 121 between feed lines 118*a* and 118*b* (e.g., in space 120, which has a width of W1). Intra-cavity wall 122 has a width W2. Intra-cavity wall 122 partitions cavity 121 into sub-cavities 128*a* and 128*b*. Walls 126, intra-cavity wall 122 and ground plane 110 present an electrically reflecting boundary condition to the electromagnetic fields inside cavity 121. The electromagnetic fields are thus substantially internally isolated within each sub-cavity 128*a* and 128*b*, which are also substantially isolated from the other cavities 121 of the structure.

As shown in FIG. 3, intra-cavity wall 122 has a height H2. As indicated by the dashed lines, H2 might be less than, or equal to, H1, such that the height of intra-cavity wall 122 might be less than, or equal to, the height of walls 126. The height of walls 126 and intra-cavity wall 122 might be used to achieve (e.g., "tune") specific operating parameters of the antenna. For example, the heights H1 and H2 might be used to tune the return loss (e.g., $S_{11}$) of the antennas. However, for antennas that are planar with an exterior surface of a vehicle (e.g., an aircraft), heights H1 and H2 might desirably be kept to minimum heights to reduce the overall size and weight of array 100. For example, in described embodiments, the height, H1, of walls 126 and the height, H2, of intra-cavity wall 122 are equal. For example, in described embodiments, such as an X-band system, the height, H1, of walls 126 and the height, H2, of intra-cavity wall 122 is equal to 0.5 inches. It should be appreciated that other heights for H1 and H2 might be beneficially employed. For example, H1 and/or H2 might be reduced for more narrow-band operation.

Similarly, intra-cavity wall 122 has a width, W2, that is less than the width of space 120 (e.g., W1), such that intra-cavity wall 122 fits within space 120 between feed lines 118*a* and 118*b*. In illustrative embodiments, the width W1 might be used to tune the coupling between feed lines 118 and patch 112, and the width W2 might be used to tune the cross-polarization (e.g., $S_{21}$) of the antennas, where a larger width increases isolation. However, for antennas mounted to a vehicle (e.g., an aircraft), widths W1 and W2 might desirably be kept to minimum widths to reduce the overall size and weight of array 100. Since the purpose of intra-cavity wall 122 is to block radiation between orthogonal ports/polarizations, the width, W2, of intra-cavity wall 122 is desirably kept as thin as possible based on practical manufacturing tolerances. For example, in an S-band embodiment, W2 is 0.050 inches. In an illustrative X-band embodiment, W2 is 0.0125 inches. In each embodiment, W1 is slightly larger than W2, for example in an S-band embodiment, W1 is 0.060 inches, and in an X-band embodiment, W1 is 0.015 inches. It should be appreciated that other widths for W1 and W2 might be beneficially employed.

Returning to FIG. 1, in described embodiments, layers 102, 104, 106, 108 and 110 might be fabricated individually and then stacked together. In some embodiments, patch antenna layer 102, feed layer 106 and cavity structure layer 108 preferably use Ni—Au or Ni-Solder plating that is applied using standard plating techniques. The cavity-backed array structure 100 is then formed by stacking layers 102, 104, 106, 108 and 110 and re-flowing solder, as is generally known. Alternatively, layers 102, 104, 106, 108 and 110 might be laminated together using conductive adhesive pre-forms. Thus, cavity-backed patch antenna array 100 might be formed by either a low temperature solder or low temperature electrically conductive adhesive techniques. Other manufacturing techniques might also be used depending upon the needs of a particular application and the materials from which the antenna is provided.

Returning to FIG. 2, in operation, an RF signal is coupled between feed lines 118*a* and 118*b* and an RF transceiver (not shown) via RF couplings 202*a* and 202*b*. The RF signal is coupled from feed lines 118*a* and 118*b*. Sub-cavities 128*a* and 128*b* form electrically cut-off (non-propagating fundamental mode) waveguide cavities for coupling signals between feed lines 118*a* and 118*b* and patch 112.

When viewed as a transmission line, each patch 112 presents an equivalent shunt impedance having a magnitude that is controlled by the dimensions of patch 112 and dielectric constant of dielectric layer 104. The shunt impedance and relative separation of the patches can be adjusted to match the antennas to resonate at a desired frequency.

Figure 4:
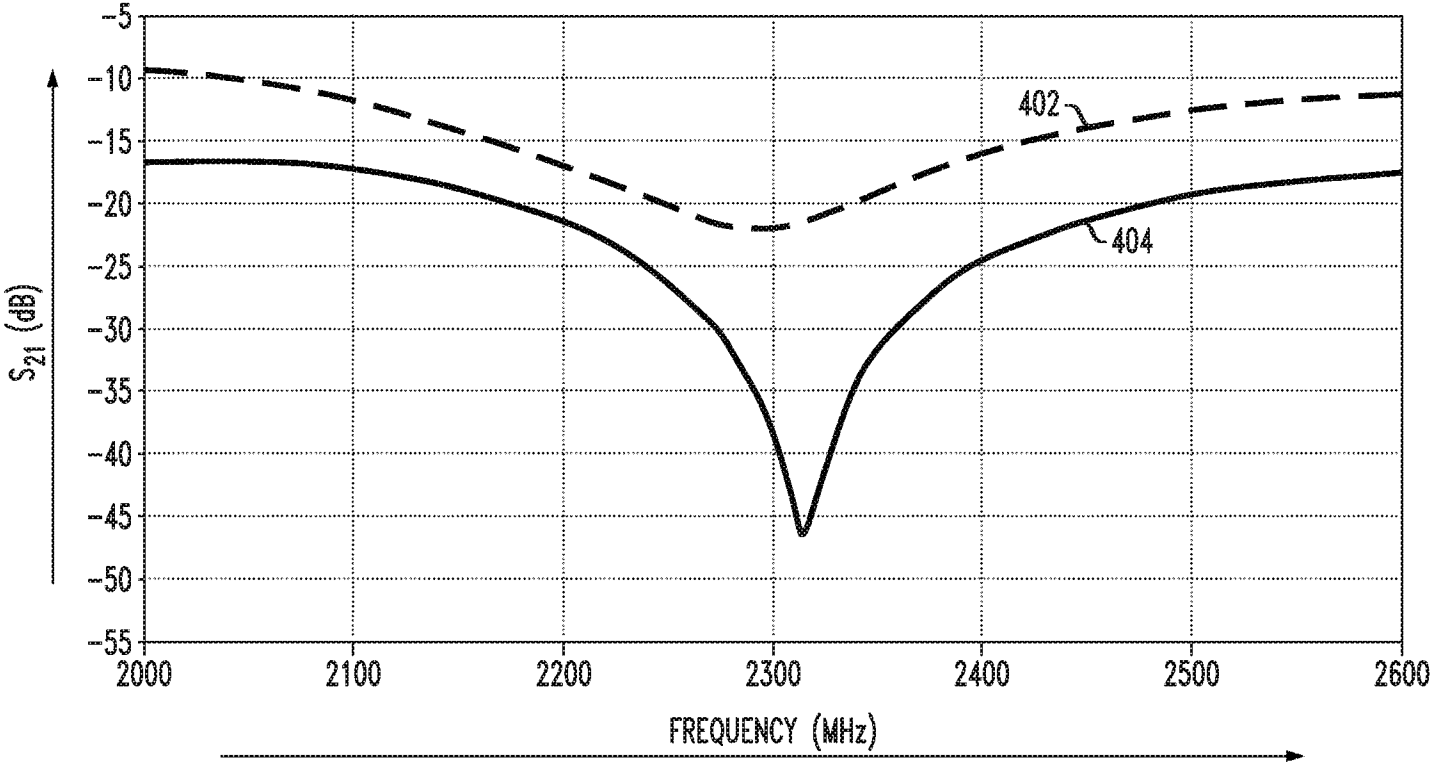
FIG. 4 is a plot of cross-polarization isolation versus frequency for prior art antennas and antennas having an intra-cavity wall in accordance with illustrative embodiments.

Referring now to FIG. 4, curves 402 and 404 show cross-polarization isolation (e.g., $S_{21}$) between orthogonal polarizations measured in a single cavity-backed microstrip patch antenna (e.g., one element of array 100). In particular, curve 402 shows a plot of the cross-polarization isolation of a cavity-backed microstrip patch antenna without intra-cavity wall 122. Curve 404 shows a plot of the cross-polarization isolation of patch 112 with intra-cavity wall 122. As shown by curve 404 in FIG. 4, adding intra-cavity wall 122 improves cross-polarization isolation versus antennas without an intra-cavity wall (curve 402). For example, as shown in FIG. 4, in an illustrative embodiment, adding intra-cavity wall 122 achieves an improvement in isolation across a frequency range of 2.2 GHz to 2.4 GHz. In some embodiments, the intra-cavity walls increase isolation between orthogonal polarizations (e.g., $S_{21}$) by 10 dB. Such increase in isolation results in an increase of about 0.4 dB in realized gain for each polarization of patch 112.

Figure 5:
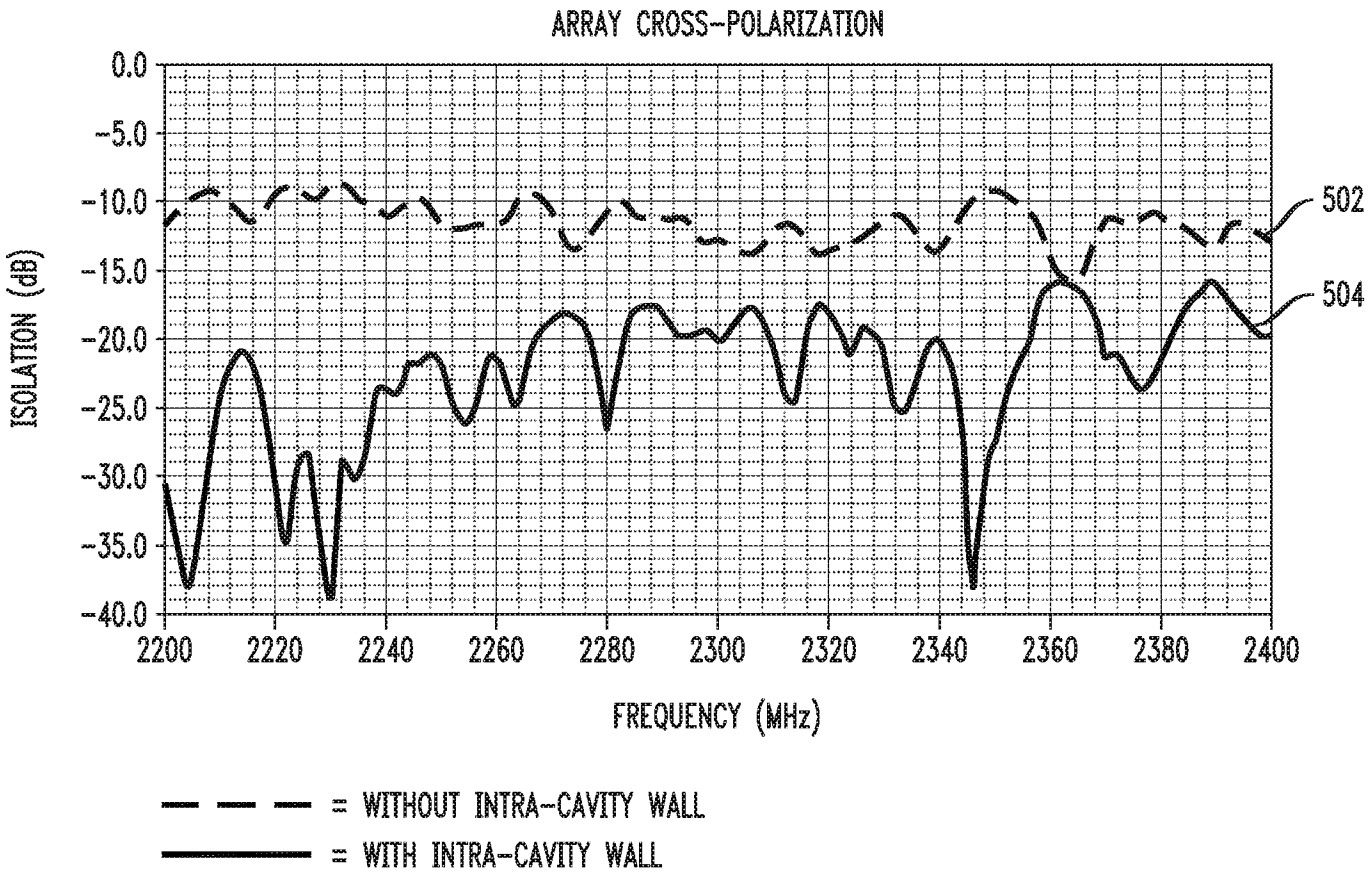
FIG. 5 is plot of far-field array cross-polarization discrimination versus frequency for prior art antennas and antennas having an intra-cavity wall in accordance with illustrative embodiments.

Referring now to FIG. 5 curves 502 and 504 show a measured far-field cross-polarization discrimination characteristic of cavity-backed patch antenna array 100. In particular, curve 502 shows a plot of the measured far-field cross-polarization discrimination of an array of patches 112 without intra-cavity wall 122. Curve 504 shows a plot of the measured far-field cross-polarization discrimination of an array of patches 112 having intra-cavity 122. As shown by curve 504 in FIG. 5, adding intra-cavity wall 122 improves far-field cross-polarization discrimination versus antennas without an intra-cavity wall (curve 502). For example, as shown in FIG. 5, in an illustrative embodiment, adding intra-cavity wall 122 achieves an average of 10 dB improvement in far-field cross-polarization discrimination across a band of 2.2 GHz to 2.4 GHz.

Thus, described embodiments improve isolation between adjacent antennas in array 100 while simultaneously improving cross-polar isolation within each antenna. First, cavity walls 126 reduce back radiation from the patch apertures, and second, intra-cavity wall 122 improves the isolation between orthogonal polarization ports within each cavity.

Reference herein to "one embodiment" or "an embodiment" means that a particular feature, structure, or characteristic described in connection with the embodiment can be included in at least one embodiment of the claimed subject matter. The appearances of the phrase "in one embodiment" in various places in the specification are nonecessarily all referring to the same embodiment, nor are separate or alternative embodiments necessarily mutually exclusive of other embodiments. The same applies to the term "implementation."

As used in this application, the words "exemplary" and "illustrative" are used herein to mean serving as an example, instance, or illustration. Any aspect or design described herein as "exemplary" or "illustrative" is not necessarily to be construed as preferred or advantageous over other aspects or designs. Rather, use of the words "exemplary" and "illustrative" is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

To the extent directional terms are used in the specification and claims (e.g., upper, lower, parallel, perpendicular, etc.), these terms are merely intended to assist in describing the embodiments and are not intended to limit the claims in any way. Such terms, do not require exactness (e.g., exact perpendicularity or exact parallelism, etc.), but instead it is intended that normal tolerances and ranges apply. Similarly, unless explicitly stated otherwise, each numerical value and range should be interpreted as being approximate as if the word "about", "substantially" or "approximately" preceded the value of the value or range.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements. Signals and corresponding nodes or ports may be referred to by the same name and are interchangeable for purposes here.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

It will be further understood that various changes in the details, materials, and arrangements of the parts that have been described and illustrated herein might be made by those skilled in the art without departing from the scope of the following claims.

We claim:

1. An antenna for transmitting and receiving radio frequency (RF) signals, the antenna comprising:

an antenna element;

an antenna feed network coupled to the antenna element, the antenna feed network disposed on a first side of the antenna element; and a cavity structure disposed about the antenna feed network, the cavity structure comprising:

conductive walls defining an antenna element cavity, the conductive walls having a height defining a depth of the antenna element cavity; and an intra-cavity wall disposed within the antenna element cavity between feed lines of the antenna feed network, wherein the feed lines are disposed within the antenna element cavity and separated in the antenna element cavity by the intra-cavity wall, and wherein the intra-cavity wall is provided having dimensions selected to reduce cross-coupling within the antenna element cavity.

2. The antenna of claim 1, wherein the intra-cavity wall has a height equal to the height of the conductive walls.

3. The antenna of claim 1, wherein the intra-cavity wall has a height that is less than the height of the conductive walls.

4. The antenna of claim 1, wherein the intra-cavity wall has a width less than a width between the feed lines of the antenna feed network.

5. The antenna of claim 1, wherein the height of the conductive walls and the height of the intra-cavity wall are determined based, at least in part, upon a return loss characteristic of the antenna.

6. The antenna of claim 5, wherein the height of the conductive walls and the height of the intra-cavity wall are determined to increase the return loss characteristic for a predetermined physical size of the antenna.

7. The antenna of claim 5, wherein the height of the conductive walls is approximately 0.1 to 0.5 wavelengths of a frequency of operation of the antenna, and wherein the height of the intra-cavity wall is approximately 0.1 to 0.5 wavelengths of the frequency of operation of the antenna.

8. The antenna of claim 5, wherein the height of the conductive walls is equal to a height of the antenna element.

9. The antenna of claim 1, wherein the intra-cavity wall is provided having dimensions selected to provide isolation between orthogonally polarized signals of the antenna element.

10. The antenna of claim 9, wherein the intra-cavity wall provides a gain factor of the antenna element, the gain factor based on the isolation between orthogonal polarized signals.

11. The antenna of claim 1, further comprising a radome disposed above a top surface of the antenna element.

12. The antenna of claim 11, wherein the intra-cavity wall partitions the antenna element cavity into a first sub-cavity and a second sub-cavity, and the feed lines are disposed within the first sub-cavity and the second sub-cavity.

13. The antenna of claim 1, wherein a dielectric layer is disposed between the antenna feed network and the antenna element.

14. The antenna of claim 1, wherein a ground plane is disposed on a rear side of the cavity structure.

15. The antenna of claim 1, wherein the antenna element comprises a microstrip patch, wherein the microstrip patch is provided having a shape such that the antenna element is responsive to radio frequency signals having multiple polarizations.

16. The antenna of claim 15, wherein the microstrip patch is planar with a top side of the cavity structure.

17. The antenna of claim 16, wherein a dielectric layer is disposed over the top side of the cavity structure.

18. The antenna of claim 1, comprising a plurality of antenna elements.

19. An antenna array comprising:

a plurality of antennas for transmitting and receiving radio frequency (RF) signals, each antenna comprising:

an antenna element;

an antenna feed network coupled to the antenna element, the antenna feed network disposed on a first side of the antenna element; and a cavity structure disposed about the antenna feed network, the cavity structure comprising:

conductive walls defining an antenna element cavity, the conductive walls having a height defining a depth of the cavity; and an intra-cavity wall disposed within the antenna element cavity between feed lines of the antenna feed network, wherein the feed lines are disposed within the antenna element cavity and separated in the antenna element cavity by the intra-cavity wall.

20. The antenna array of claim 19, wherein the intra-cavity wall has a height that is less than or equal to the height of the conductive walls, and wherein the intra-cavity wall has a width less than a width between the feed lines of the antenna feed network, wherein the height of the conductive walls and the height of the intra-cavity wall are determined to increase the return loss characteristic for a predetermined physical size of the antenna.

21. The antenna array of claim 19, wherein the intra-cavity wall is provided having dimensions selected to provide isolation between orthogonally polarized signals of the antenna element.

22. The antenna array of claim 19, wherein the antenna element comprises a microstrip patch and wherein the microstrip patch is provided having a shape such that the antenna element is responsive to radio frequency signals having multiple polarizations.

23. The antenna array of claim 19, wherein one or more arrays are disposed on a planar surface of at least one of a vehicle, a building, and an aircraft.

* * * * *